US008422918B2

(12) United States Patent
Nir

(10) Patent No.: US 8,422,918 B2
(45) Date of Patent: Apr. 16, 2013

(54) IMAGE FORMING APPARATUS AND METHODS THEREOF

(75) Inventor: Jonathan Nir, Mesheh (IL)

(73) Assignee: Hewlett-Packard Indigo B.V., Netanya (NL)

( * ) Notice: Subject to any disclaimer, the term of this patent is extended or adjusted under 35 U.S.C. 154(b) by 242 days.

(21) Appl. No.: 13/097,554

(22) Filed: Apr. 29, 2011

(65) Prior Publication Data

US 2012/0275827 A1 Nov. 1, 2012

(51) Int. Cl.
*G03G 15/10* (2006.01)

(52) U.S. Cl.
USPC ..... 399/237; 399/238

(58) Field of Classification Search ..... 399/57, 399/58, 237, 238, 239
See application file for complete search history.

(56) References Cited

U.S. PATENT DOCUMENTS 3,994,257 A * 11/1976 Komori et al. ..... 399/57
6,480,684 B2 * 11/2002 Shindo ..... 399/57

* cited by examiner

*Primary Examiner* — Hoang Ngo

(57) ABSTRACT

An ink tank apparatus usable with an image forming apparatus and methods of mixing ink in an ink tank apparatus are disclosed. The ink tank apparatus and methods include directing ink particles against at least one of an impeller and an interior surface of a head housing to reduce a particle size of the respective ink particles.

20 Claims, 7 Drawing Sheets

IMAGE FORMING APPARATUS AND METHODS THEREOF

BACKGROUND

Image forming apparatuses such as liquid electrophotography systems include a fluid applicator unit such as binary ink developers to provide charged liquid toner to a latent image on a photoconductive member to form fluid images. The photoconductive member transfers the fluid images therefrom onto an intermediate transfer member. Subsequently, the intermediate transfer member transfers the fluid images to media. The image forming apparatuses include at least one ink tank apparatus to store the ink to be provided to the fluid applicator unit.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
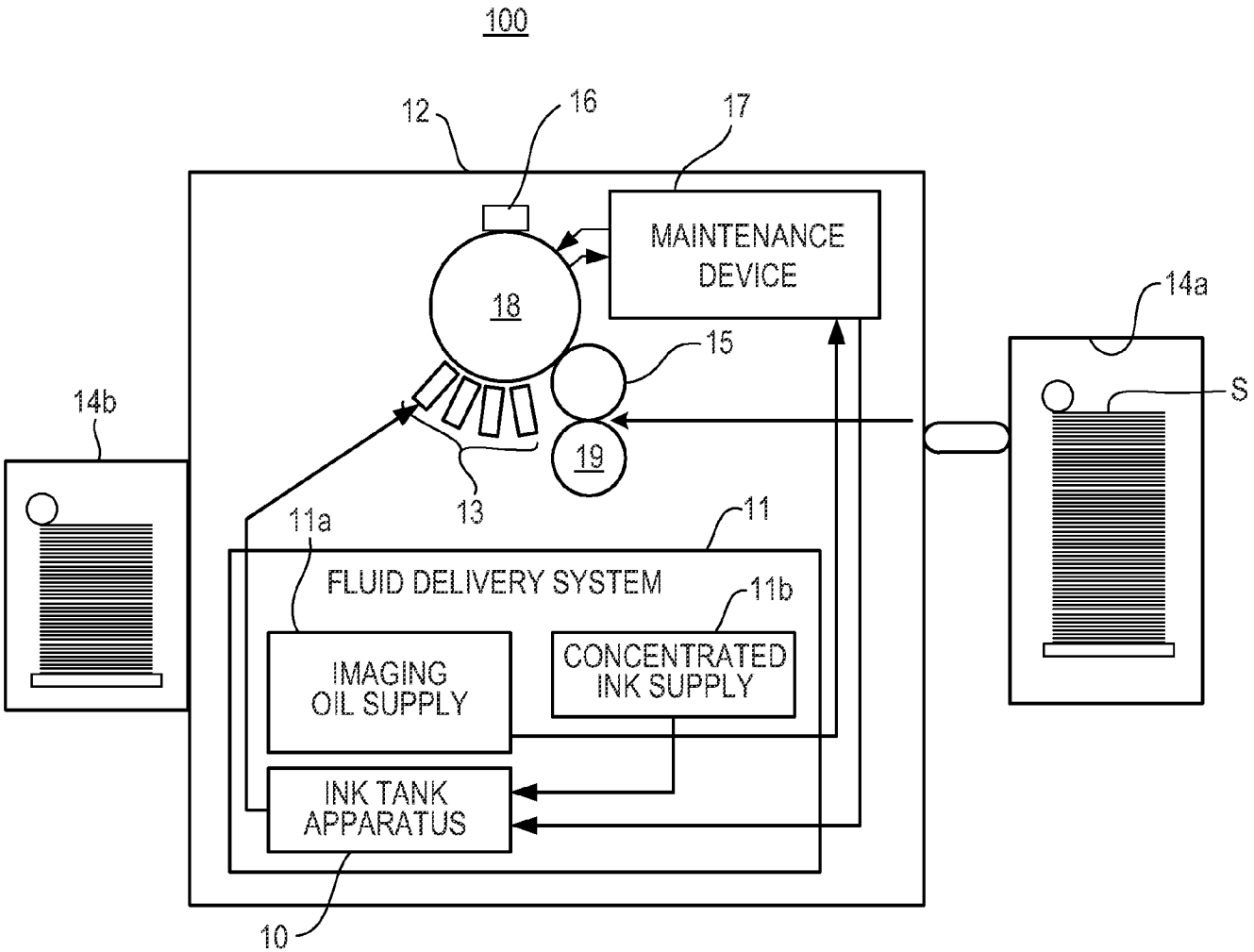
FIG. 1 is a schematic view illustrating an image forming apparatus such as a liquid electrophotography system according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses such as liquid electrophotography systems provide ink such as liquid toner to a fluid applicator unit such as binary ink developers (BIDs). The liquid toner is charged and is provided to a latent image on a photoconductive member such as a photo imaging member (PIP) to form a fluid image, for example, by BIDs. The photoconductive member, in turn, provides the fluid image to an intermediate transfer member which transfers the fluid image onto media. The image forming apparatuses include at least one ink tank apparatus which stores the ink such as liquid toner therein to provide liquid toner to the fluid applicator unit. The ink tank apparatus may also form ink agglomerates from ink particle cohesion over extended periods of inactivity and receive ink particles such as ink agglomerates (e.g., chunks of developed ink from the photoconductive member), for example, either directly or through a maintenance device. The ink tank apparatus may also receive concentrated ink having ink particles.

Periodically, however, at least due to ink agglomerates and concentrated ink provided to the ink tank apparatus, ink particle size distribution of the ink may fall outside of a predetermined ink particle size distribution range due to, for example, an increase in an amount of oversize ink particles per volume of ink. The ink particle size distribution, for example, is an amount of distribution of ink particles of various sizes in the ink and having a median corresponding to a respective ink particle size. An example of an ink particle size distribution may be 7 micrometers (μm) median with a 1.5% tail greater than 20 μm. The predetermined ink particle size distribution range is a predetermined range of ink particle size distributions considered acceptable for the ink in the ink tank apparatus. The oversize ink particle is an ink particle having a particle size greater than a predetermined recommended particle size. Also, homogeneity of the ink may decrease to unacceptable levels due to phase separation of ink components, for example, during extended periods of inactivity. Consequently, image quality defects may increase and the lifespan of image forming apparatus components may decrease.

In examples, an ink tank apparatus usable with an image forming apparatus includes, among other things, a mixing head device disposed in a lower chamber of an ink tank body. The mixing head device includes a head housing forming a housing cavity and an impeller disposed in the housing cavity to rotate therein. The head housing includes an interior surface and an injection port to direct concentrated ink having a first set of ink particles into the housing cavity. The impeller is configured to rotate in the ink within the housing cavity to direct at least the first set of ink particles therein against at least one of the impeller and the interior surface of the head housing to reduce the particle size of the at least first set of ink particles in contact therewith and to mix the ink. Consequently, shearing of the ink particles upon impact with the impeller and/or interior surface reduces an amount of oversize ink particles per volume of ink. In addition, mixing of the ink maintains homogeneity of the ink at an acceptable level and maintains ink particle size distribution of the ink within a predetermined ink particle size distribution range. Thus, image quality defects and the shortening of the lifespan of image forming apparatus components due to an unacceptable amount of oversize ink particles, homogeneity levels and an ink particle size distribution may be reduced.

FIG. 1 is a schematic view illustrating an image forming apparatus such as a liquid electrophotography system (LEP) according to an example. Referring to FIG. 1, a LEP 100 includes an image forming unit 12 that receives media S from an input unit 14*a* and outputs the media S to an output unit 14*b*. The image forming unit 12 includes a fluid applicator unit 13 and a photoconductive member 18 on which images can be formed. The photoconductive member 18 may be charged with a suitable charger (not illustrated) such as a charge roller. Portions of the outer surface of the photoconductive member 18 that correspond to features of the image can be selectively discharged by a laser writing unit 16 to form an electrostatic and/or latent image thereon. The LEP 100 also includes a fluid delivery system 11 including an imaging oil supply 11*a*, a concentrated ink supply 11*b* and at least one ink tank apparatus 10.

In an example, the fluid applicator unit 13 may include one BID. In other examples, the fluid applicator unit 13 may include a plurality of BIDs in which each BID may correspond to a respective color fluid such as black ink, cyan ink, yellow ink, and magenta ink. Accordingly, the LEP 100 may include a plurality of ink tank apparatuses (not illustrated) in which one ink tank apparatus 10 corresponds to each BID applying a different color ink. The imaging oil supply 11*a* may supply imaging oil, for example, such as Isopar, trademarked by Exxon Corporation, to a maintenance device 17. The maintenance device 17 may use the imaging oil to at least clean the photoconductive member 18. The maintenance device 17 may also receive ink particles in the form of ink agglomerates such as chunks of developed ink from the photoconductive member 18 and supply them to the ink tank apparatus 10 to be reused. The concentrated ink supply 11*b* may supply concentrated ink to the ink tank apparatus 10, for example, to replenish ink supplied from the ink tank apparatus 10 to the fluid applicator unit 13 and/or to maintain a predetermined amount of density of the ink therein.

Referring to FIG. 1, the ink tank apparatus 10 may supply ink such as liquid toner, for example, Electrolnk, trademarked by Hewlett-Packard Company, to a fluid applicator unit 13. The fluid applicator unit 13 applies the ink such as liquid toner to the electrostatic and/or latent image to form a fluid image on the photoconductive member 18 to be transferred to an intermediate transfer member (ITM) 15. The ITM 15 is configured to receive the fluid image from the photoconductive member 18 and transfer the fluid image to the media S. During the transfer of the fluid image from the ITM 15 to the media S, the media S is pinched between the ITM 15 and an impression member 19. Once the fluid image has been transferred to the media S, the media S can be transported to the output unit 14*b*.

Figure 2:
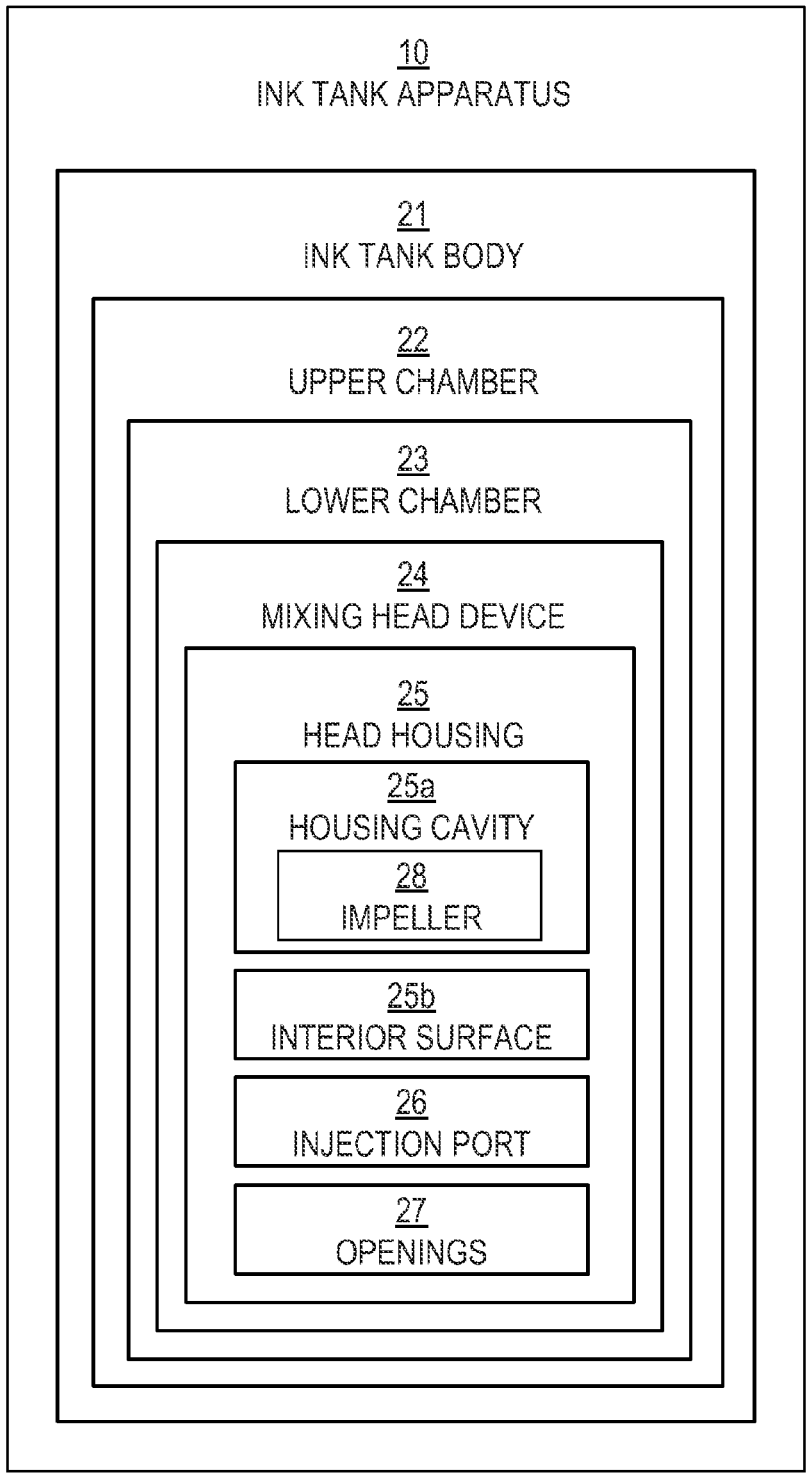
FIG. 2 is a block diagram illustrating an ink tank apparatus according to an example.
Figure 3:
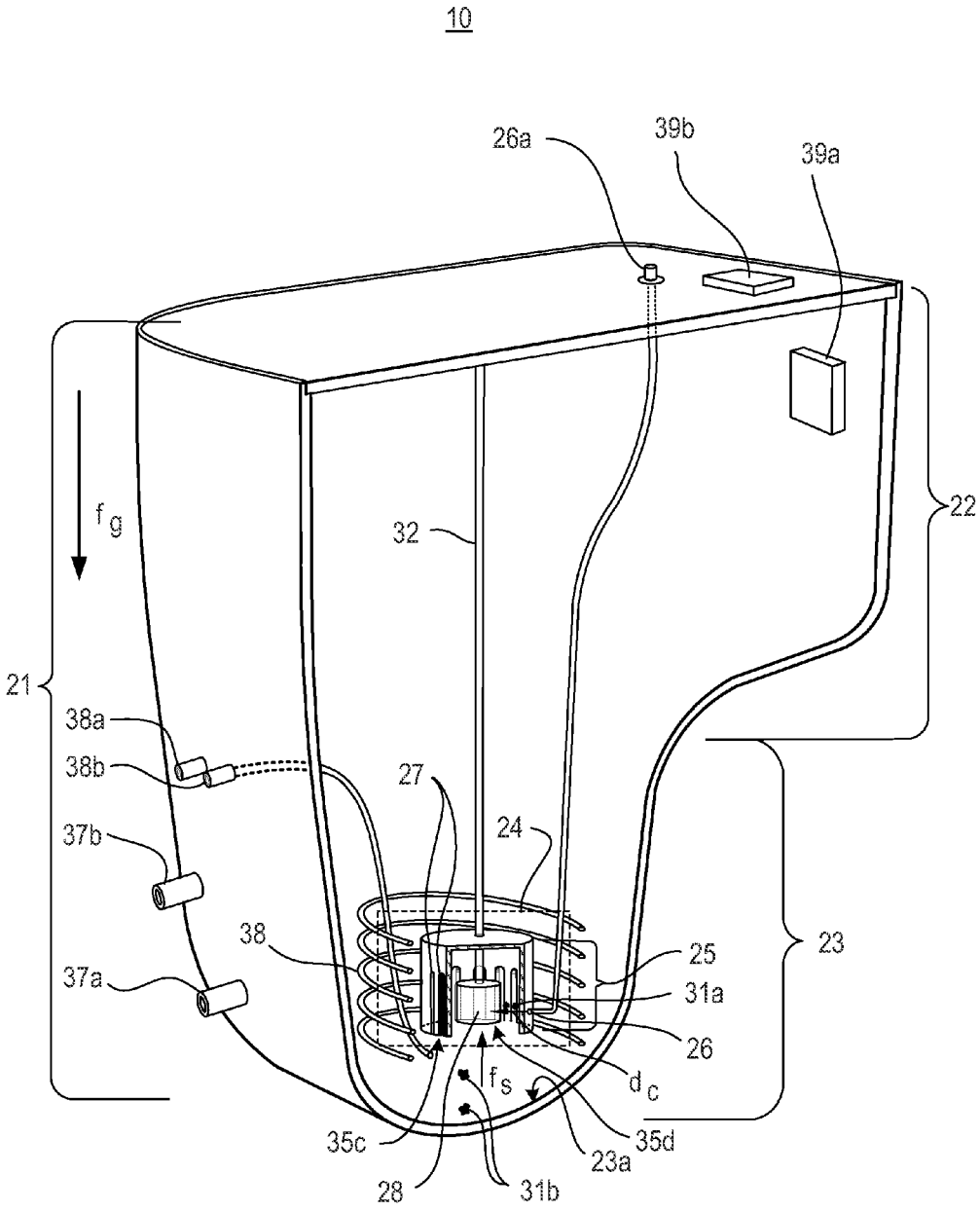
FIG. 3 is a perspective view illustrating a portion of an ink tank apparatus according to an example.

FIG. 2 is a block diagram illustrating an ink tank apparatus according to an example. FIG. 3 is a perspective view illustrating a portion of an ink tank apparatus according to an example. The ink tank apparatus 10 is usable, for example, with an image forming apparatus 100 (FIG. 1). Referring to FIGS. 2 and 3, in the present example, the ink tank apparatus 10 includes an ink tank body 21 and a mixing head device 24. The ink tank body 21 includes an upper chamber 22 and a lower chamber 23 disposed below the upper chamber 22 to store ink therein. For example, the lower chamber 23 may be disposed beneath the upper chamber 22 with respect to a gravitational force direction $f_g$. The mixing head device 24 is disposed in the lower chamber 23.

Referring to FIGS. 2 and 3, in the present example, the mixing head device 24 includes a head housing 25 forming a housing cavity 25*a* and an impeller 28 disposed in the housing cavity 25*a*. The head housing 25 includes an interior surface 25*b*, an injection port 26 to direct concentrated ink having a first set of ink particles 31*a* into the housing cavity 25*a*, and a plurality of openings 27 to transport the ink within the housing cavity 25*a* to outside the housing cavity 25*a*. In an example, the openings 27 may be in a form of elongated slots. In the present example, the mixing head device 24 is an online mixing head device. That is, the concentrated ink coming from the injection port 26 is sheared in one pass through the mixing head device 24 and the ink particle size distribution is maintained within a predetermined ink particle size distribution range to constantly be ready to be supplied to a fluid applicator unit 13 (FIG. 1) to form images. Thus, batch mixing time interval recesses may be avoided. The impeller 28 is configured to rotate in the ink within the housing cavity 25*a* to direct at least the first set of ink particles 31*a* therein against at least one of the impeller 28 and the interior surface 25*b* of the head housing 25 to reduce the particle size of the at least first set of ink particles 31*a* in contact therewith.

For example, a speed of rotation of the impeller 28, a shape of at least a portion of the lower chamber 23 and/or an injection of the concentrated ink through the injection port 26 into the housing cavity 25*a* may establish flow paths having a respective direction and respective velocity within the ink tank body 21. Such flow paths may direct ink particles into the impeller 28 to shear the respective ink particles in contact therewith. In addition, the impeller 28 contacting the respective ink particles may apply force to redirect them into the interior surface 25*b* of the head housing 25 to shear the respective ink particles in contact therewith. That is, a force of impact between the respective ink particles and the impeller 28 and/or interior surface 25*b* of the head housing 25 may impart shearing forces onto the respective ink particles causing them to break (e.g., shear) into reduced-size ink particles.

The flow paths may also reduce phase separation of the ink components, increase heat transfer rates, and increase response time of additives added to the ink. In an example, the ink tank apparatus 10 may include an exterior injection port 26*a*, for example, to receive a conduit (not illustrated) from the concentrated ink supply 11*b* (FIG. 1) to supply concentrated ink therein to the ink tank body 21. Subsequently, the concentrated ink may be supplied to the housing cavity 25*a* through the injection port 26. The ink tank apparatus 10 may also include an outlet supply port 37*b* on the ink tank body 21 to supply the ink from the ink tank body 21 to a fluid applicator unit 13.

Referring to FIGS. 2 and 3, in an example, the impeller 28 may also be configured to establish suction force $f_s$ between a bottom surface 23*a* of the lower chamber 23 of the ink tank body 21 and the impeller 28. The suction force $f_s$ may transport a second set of ink particles 31*b* disposed proximate to the bottom surface 23*a* of the lower chamber 23 through a housing opening 35*d* to the impeller 28. The second set of ink particles 31*b* may include ink agglomerates formed in the ink tank body 21 over time and/or provided in a form of chunks of developed ink from the photoconductive member 18 supplied to the ink tank body 21 through a recovery port 37*a*, for example, by a maintenance device 17 (FIG. 1). The impeller 28 is configured to rotate to direct the first set of ink particles 31*a* and the second set of ink particles 31*b* against at least one of the impeller 28 and the interior surface 25*b* of the head housing 25.

In an example, the impeller 28 rotates at a predetermined range of speed to establish shear forces to shear respective ink particles which are greater than a predetermined particle size to maintain an ink particle size distribution within a predetermined ink particle size distribution range. The impact between the impeller 28 and/or interior surface 25*b* of the head housing 25 may be of a sufficient force to break the respective ink particles into reduced-size ink particles. In addition, the respective reduced-size ink particles are mixed in the ink by the rotation of the impeller 28. Accordingly, an ink particle size distribution is maintained in the ink within a predetermined ink particle size distribution range.

Referring to FIG. 3, in an example, the ink tank apparatus 10 may also include a heat transfer member 38 configured to transport a transfer regulating fluid therein to cool the ink stored in the ink tank body 21 as a temperature of the ink may undesirably increase due to heat generated by the image forming apparatus 100. The heat transfer member 38 is disposed in the ink tank body 21 and surrounds the head housing 25. For example, the heat transfer member 38 may be in a form of a tube to transport (e.g., circulate) temperature regulating fluid such as water therein. The tube may be disposed in a helical manner surrounding the head housing 25. In an example, the ink tank body 21 may include a regulating fluid inlet 38*a* configured to provide temperature regulating fluid to the heat transfer member 38 and a regulating fluid outlet 38*b* configured to receive temperature regulating fluid from the heat transfer member 38. The temperature regulating fluid may be cooled by a cooling source (not illustrated) prior to being input to the regulating fluid inlet 38*a*.

The ink may be cooled by heat transferring from the ink to the temperature regulating fluid being transported in the heat transfer member 38. The temperature regulating fluid may be transported out of the ink tank body 21 to be re-cooled. The rate of heat transfer between the ink and the temperature regulating fluid in the heat transfer member 38 may be increased by the flow paths in the ink interacting with the heat transfer member 38. For example, an increase in velocity of the flow paths interacting with the heat transfer member 38 increases an ink heat transfer convection coefficient resulting in an increased heat transfer rate.

Referring to FIG. 3, in an example, the ink tank apparatus 10 may also include a sensor unit 39*a* and a density control module 39*b*. The sensor unit 39*a* may be disposed in the ink tank apparatus 10, for example in the ink tank body 21. The sensor unit 39*a* is configured to determine a density value of the ink stored in the ink tank body 21. For example, the sensor unit 39*a* may include a fluid density sensor disposed in the ink tank body 21 and in contact with the ink stored therein. The density control module 39*b* is configured to control the flow of the concentrated ink through the injection port 26 based on the density value determined by the sensor unit 39*a*.

The density control module 39*b* may be implemented in hardware, software, or in a combination of hardware and software. For example, the density control module 39*b* may initiate or stop the flow of concentrated ink into the housing cavity 25*a*, for example, through control of an ink fluid pump (not illustrated), programmable fluid valve (not illustrated), and/or machine readable instructions (not illustrated) in response to whether the ink density is determined to be within a predetermined density range. In other examples, the density control module 39*b* may be implemented in whole or in part as a computer program stored in an image forming apparatus 100 locally or remotely, for example, in a server or a host computing device considered herein to be part of the image forming apparatus 100.

Figure 4A:
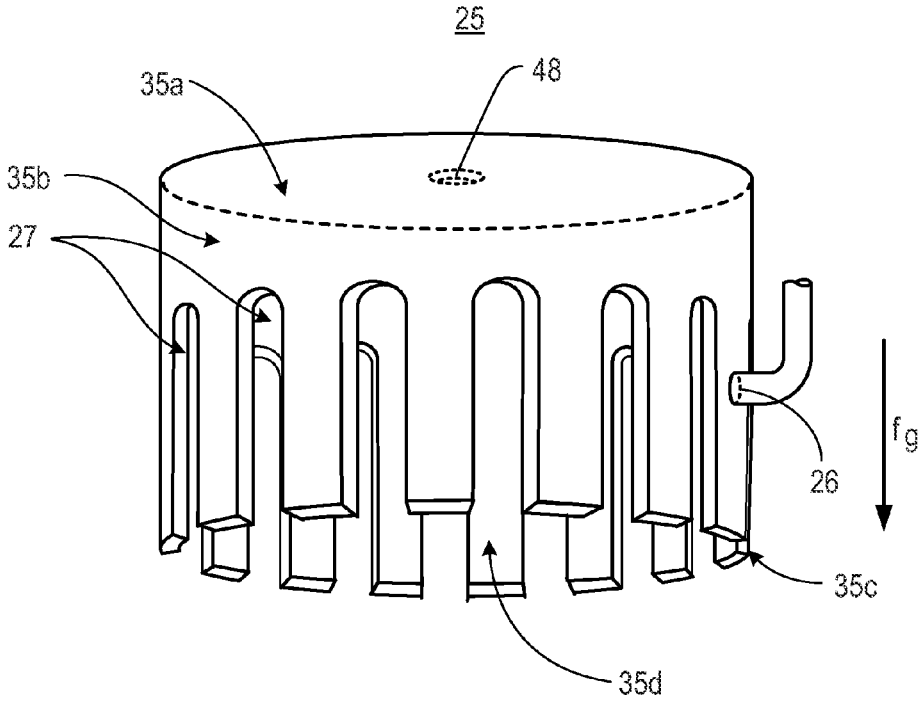
FIG. 4A is a perspective view illustrating a head housing of a mixing head device of the ink tank apparatus of FIG. 3 according to an example.
Figure 4B:
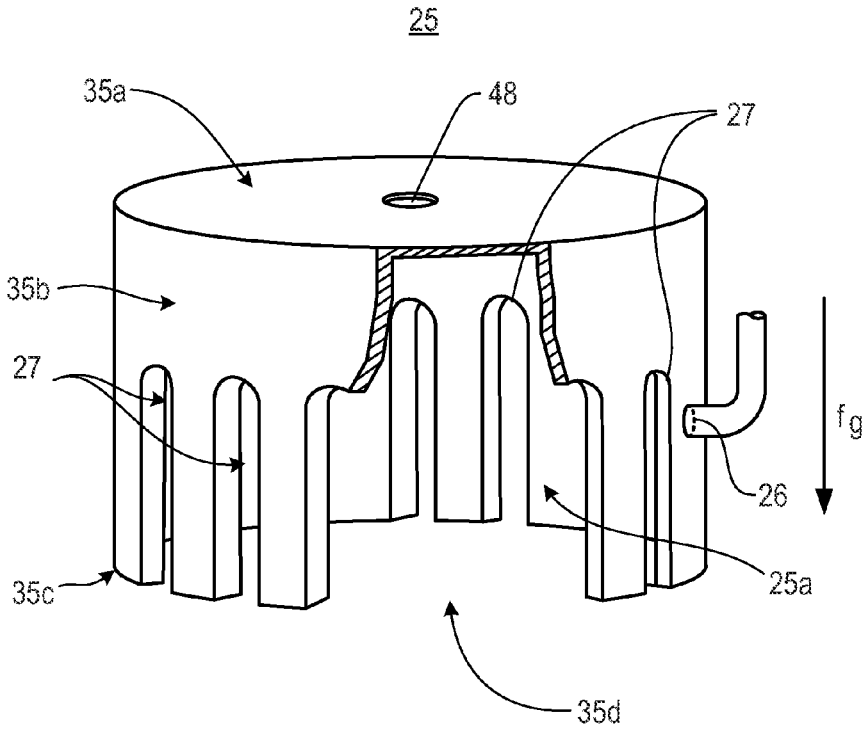
FIG. 4B is a perspective view illustrating a portion of the head housing of FIG. 4A according to an example.

FIG. 4A is a perspective view of a head housing of a mixing head device of the ink tank apparatus of FIG. 3 according to an example. FIG. 4B is a perspective view illustrating a portion of the head housing of FIG. 4A according to an example. Referring to FIGS. 4A and 4B, in examples, the head housing 25 of the mixing head device 24 (FIG. 3) includes a top member 35*a* and a wall member 35*b* having a lower end 35*c*. The lower end 35*c* of the wall member 35*b* forms a housing opening 35*d*. The housing cavity 25*a* is formed by an inner surface 25*b* (FIG. 5) of the head housing 25 and is disposed between the top member 35*a* and the housing opening 35*d*. The injection port 26 is disposed on the wall member 35*b* to direct the concentrated ink directly at the impeller 28 (FIG. 3) disposed in the housing cavity 25*a*. Openings 27 are disposed on the wall member 35*b* to transport the ink within the housing cavity 25*a* to outside the housing cavity 25*a*. In an example, the openings 27 may have a predetermined width to prevent ink particles exceeding a predetermined particle size to pass therethrough.

Referring to FIGS. 4A and 4B, in an example, the wall member 35*b* is formed in a shape of a circle. The wall member 35*b* extends from the top member 35*a* to the housing opening 35*d*. For example, the wall member 35*b* may be traverse to (e.g., generally perpendicular) and extend downward from the top member 35*a*, for example, with respect to a gravitational force direction $f_g$. In an example, the wall member 35*b* and the top member 35*a* may be integrally formed. The top member 35*a* of the head housing 25 may also include a shaft receiving hole 48 configured to receive a shaft member 32 (FIG. 3) to rotate the impeller 28. One end of the shaft member 32 may be coupled to the impeller 28 and another end of the shaft member 32 may be coupled to an ink pump motor (not illustrated) of the image forming apparatus 100 (FIG. 1).

Figure 5:
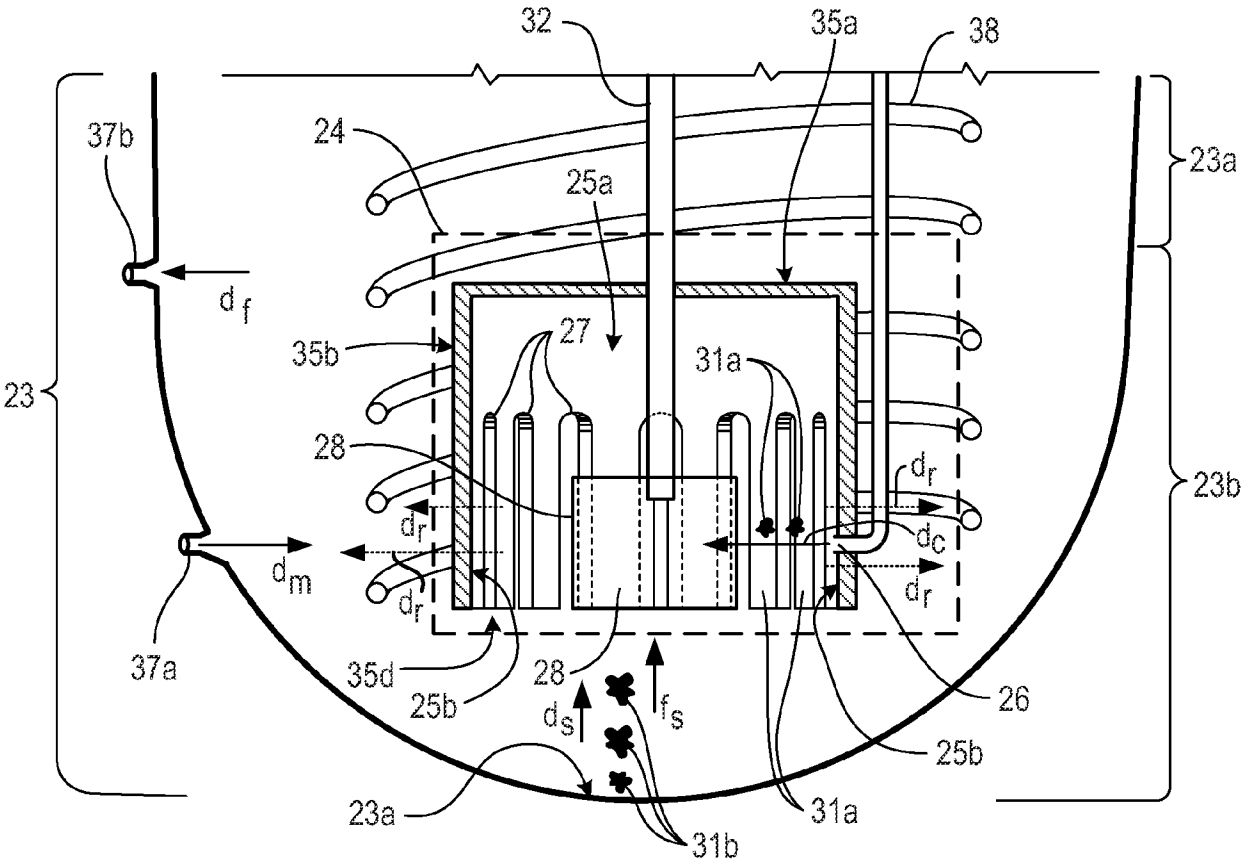
FIG. 5 is a cross-sectional view of a mixing head device disposed in a lower chamber of the ink tank apparatus of FIG. 3 according to an example.

FIG. 5 is a cross-sectional view of the mixing head device disposed in a lower chamber of the ink tank apparatus of FIG. 3 according to an example. Referring to FIG. 5, in an example, at least a portion of the lower chamber 23 of the ink tank body 21 is in a shape of a semi-circle disposed around the head housing 25 of the mixing head device 24. In an example, the lower chamber 23 may include a tubular shape in which a lower section 23*b* of the lower chamber 23 of an ink tank body 21 includes a bottom surface 23*a* thereof and forms a semi-circle about the head housing 25. For example, the semi-circle may have a radius in a range of 60 millimeters (mm) to 100 mm. The head housing 25, for example, may be centered with respect to the lower section 23*b* of the lower chamber 23 shaped as a semi-circle. In an example, the upper section 23*a* of the lower chamber 23 may include a generally rectangular section. The openings 27 of the head housing 25 are configured to transport the ink within the housing cavity 25*a* to outside the housing cavity 25*a*, for example, in an outward direction $d_r$. A heat transfer member 38 surrounding the head housing 25 is included in the ink tank body 21.

Referring to FIG. 5, in operation, concentrated ink having a first set of ink particles 31*a* is directed in an inward direction $d_c$ into the housing cavity 25*a* toward the impeller 28 to fully interact with the impeller 28. A second set of ink particles 31*b*, for example, supplied from a maintenance device 17 or formed inside the ink tank body 21, is directed in an upward direction $d_s$ to the impeller 28 due to a suction force $f_s$ generated by rotation of the impeller 28 in the ink. The speed of rotation of the impeller 28, a shape of at least a portion of the lower chamber 23 and/or an injection of the concentrated ink through the injection port 26 into the housing cavity 25*a* establish flow paths having a respective direction and respective velocity within the ink tank body 21.

Referring to FIG. 5, in operation, the established flow paths direct ink particles into the impeller 28 to shear the respective ink particles in contact therewith and/or, upon contact, the impeller 28 redirects them into the interior surface 25*b* of the head housing 25 to be sheared. In addition, the ink including the resultant reduced-size ink particles is mixed by the rotation of the impeller 28. The resultant reduced-sized ink particles may be transported from within the housing cavity 25*a* through the openings 27 to outside the housing cavity 25*a* in an outward direction $d_r$ and be, for example, evenly distributed throughout the ink. Accordingly, an ink particle size distribution is maintained in the ink within a predetermined ink particle size distribution range. The ink including the reduced-size ink particles distributed therein may be supplied to a fluid applicator unit 13 outside of the ink tank body 21 through the outlet supply port 37*b* in an exit direction $d_f$. Ink agglomerates in the form of chunks of developed ink may be provided to the ink tank body 21 through the recovery port 37*a* in an entry direction $d_m$.

Figure 6:
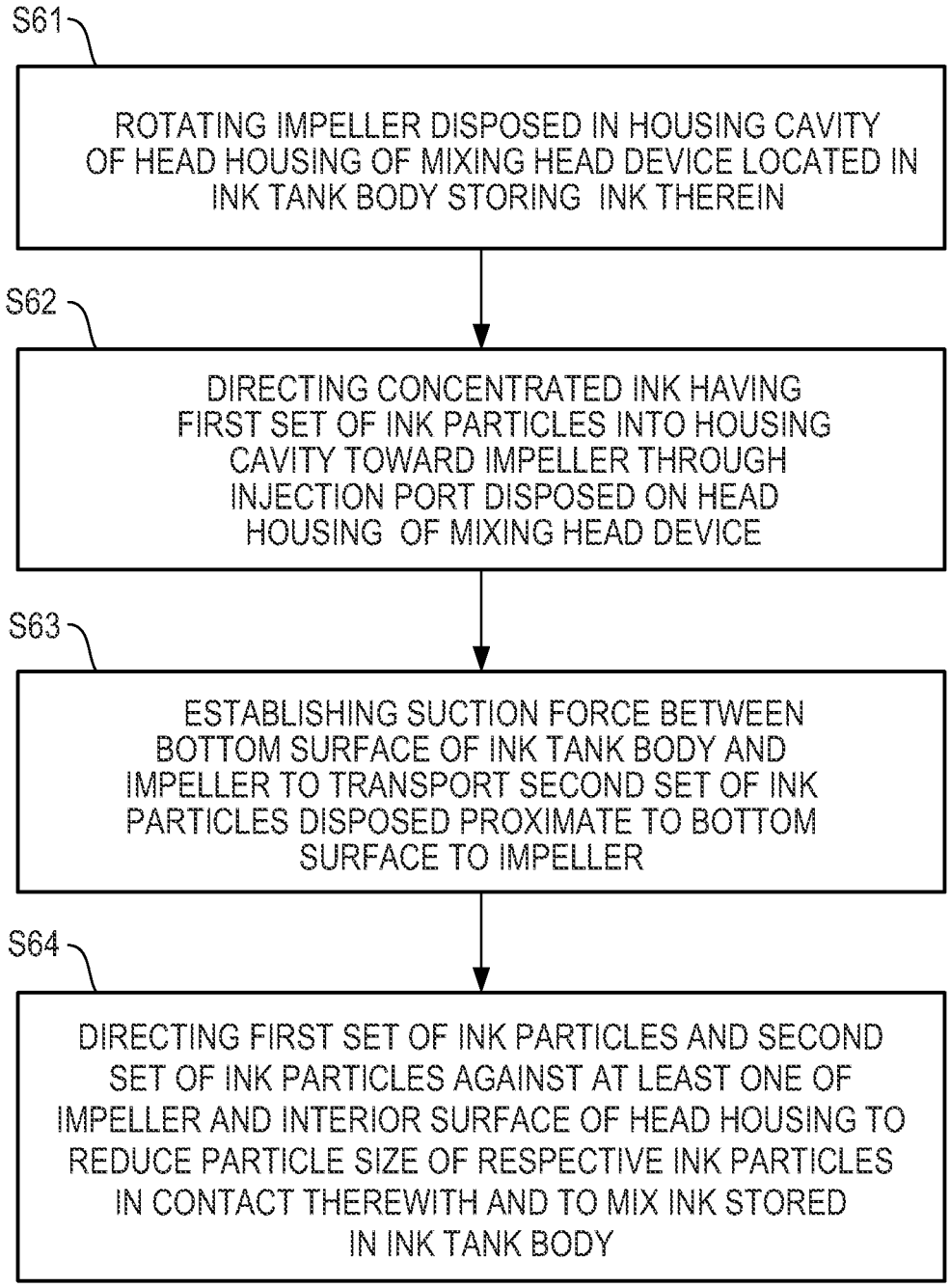
FIG. 6 is a flowchart illustrating a method of mixing ink in an ink tank apparatus of an image forming apparatus according to an example.

FIG. 6 is a flowchart illustrating a method of mixing ink in an ink tank apparatus of an image forming apparatus according to an example. Referring to FIG. 6, in block S61, an impeller disposed in a housing cavity of a head housing of a mixing head device located in an ink tank body storing ink therein is rotated therein. In an example, the impeller is rotated at a predetermined range of speed to establish shear forces to shear respective ink particles which are greater than a predetermined particle size to maintain an ink particle size distribution within a predetermined ink particle size distribution range. The ink tank body may include an upper chamber and a lower chamber disposed below the upper chamber such that the head housing is disposed in the lower chamber. The lower chamber may include a bottom surface having a concaved shape with respect to the head housing. In block S62, concentrated ink having a first set of ink particles is directed into the housing cavity toward the impeller through an injection port disposed on the head housing of the mixing head device. Thus, the concentrated ink may fully interact with the impeller 28.

Referring to FIG. 6, in block S63, a suction force is established between a bottom surface of the ink tank body and the impeller to transport a second set of ink particles disposed proximate to the bottom surface to the impeller. In block S64, the first set of ink particles and the second set of ink particles are directed against at least one of the impeller and an interior surface of the head housing. The respective ink particles directed against at least one of the impeller and the interior surface reduce the particle size of the respective ink particles in contact therewith and mix the ink stored in the ink tank body. Accordingly, ink particle size distribution may be maintained within a predetermined ink particle size distribution range.

In an example, the method may also include transporting the ink including respective reduced-size ink particles from within the housing cavity to outside the housing cavity through a plurality of openings on the head housing. For example, the reduced-size ink particles may be provided to a fluid applicator unit to form an image on a photoconductive member of the image forming apparatus. The mixing head device may perform online mixing to enable various mixing operations to take place while images are being formed by the image forming apparatus. For example, the rotating of an impeller operation, the directing concentrated ink into the housing cavity operation, the establishing a suction force operation and the directing the first set of ink particles and the second set of ink particles operation are performed while the fluid applicator unit is forming the image on the photoconductive member. The method may also include transporting temperature regulating fluid through a heat transfer member surrounding the head housing of the mixing head device to cool the ink in the ink tank body. The method may also include determining a density value of the ink stored in the ink tank body and controlling the flow of the concentrated ink through the injection port based on the determined density value.

Figure 7:
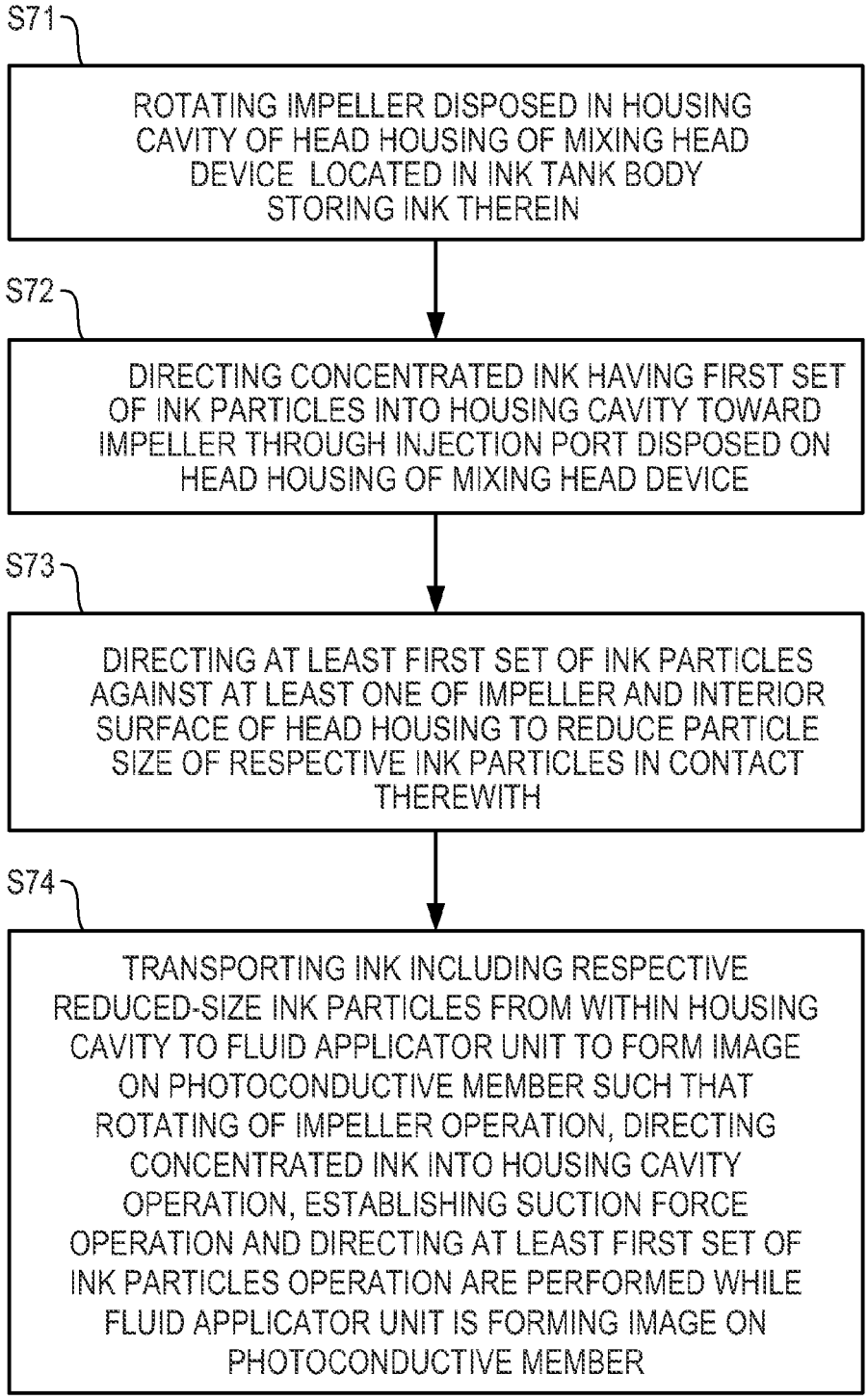
FIG. 7 is a flowchart illustrating a method of mixing ink in an ink tank apparatus of an image forming apparatus according to an example.

FIG. 7 is a flowchart illustrating a method of mixing ink in an ink tank apparatus of an image forming apparatus according to an example. Referring to FIG. 7, in block S71, an impeller disposed in a housing cavity of a head housing of a mixing head device located in an ink tank body storing ink therein is rotated therein. In block S72, concentrated ink having a first set of ink particles is directed into the housing cavity toward the impeller through an injection port disposed on the head housing of the mixing head device. Thus, the concentrated ink may fully interact with the impeller. In block S73, at least the first set of ink particles is directed against at least one of the impeller and an interior surface of the head housing to reduce the particle size of the at least first set of ink particles in contact therewith. In block S74, the ink including the respective reduced-size ink particles is transported from within the housing cavity to a fluid applicator unit to form an image on a photoconductive member such that the rotating of an impeller operation, the directing concentrated ink into the housing cavity operation, the establishing a suction force operation and the directing at least the first set of ink particles operation are performed while the fluid applicator unit is forming the image on the photoconductive member.

The method may also include a suction force being established between a bottom surface of the ink tank body and the impeller to transport a second set of ink particles disposed proximate to the bottom surface of the ink tank body to the impeller. Subsequently, the first set of ink particles and the second set of ink particles are directed against at least one of the impeller and the interior surface of the head housing to reduce the particle size of the respective ink particles in contact therewith. The method may also include temperature regulating fluid being transported through a heat transfer member surrounding the head housing of the mixing head device to cool the ink in the ink tank body.

It is to be understood that the flowcharts of FIGS. 6 and 7 illustrate an architecture, functionality, and operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 6 and 7 illustrate a specific order of execution, the order of execution may differ from that which is depicted. For example, the order of execution of two or more blocks may be scrambled relative to the order illustrated. Also, two or more blocks illustrated in succession in FIGS. 6 and 7 may be executed concurrently or with partial concurrence. All such variations are within the scope of the present disclosure.

It should also be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to." It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An ink tank apparatus usable with an image forming apparatus, the ink tank apparatus comprising:

an ink tank body including an upper chamber and a lower chamber disposed below the upper chamber to store ink therein;

a mixing head device disposed in the lower chamber, the mixing head device including a head housing forming a housing cavity and an impeller disposed in the housing cavity;

the head housing includes an interior surface, an injection port to direct concentrated ink having a first set of ink particles into the housing cavity, and a plurality of openings to transport the ink within the housing cavity to outside the housing cavity; and the impeller is configured to rotate in the ink within the housing cavity to direct at least the first set of ink particles therein against at least one of the impeller and the interior surface of the head housing to reduce the particle size of the at least first set of ink particles in contact therewith.

2. The ink tank apparatus according to claim 1, wherein the head housing further comprises:

a top member; and a wall member having a lower end, the lower end of the wall member forming a housing opening such that the housing cavity is disposed between the top member and the housing opening; and wherein the injection port is disposed on the wall member to direct the concentrated ink directly at the impeller disposed in the housing cavity.

3. The ink tank apparatus according to claim 2, wherein the wall member formed in a shape of a circle extends from the top member to the housing opening, and wherein the top member of the head housing further comprises a shaft receiving hole configured to receive a shaft member to rotate the impeller.

4. The ink tank apparatus according to claim 2, wherein the impeller is also configured to establish a suction force between a bottom surface of the lower chamber of the ink tank body to transport a second set of ink particles disposed proximate to the bottom surface through the housing opening to the impeller.

5. The ink tank apparatus according to claim 4, wherein the impeller is configured to rotate to direct the first set of ink particles and the second set of ink particles against at least one of the impeller and the interior surface of the head housing to reduce the particle size of the respective ink particles in contact therewith and to mix the ink stored in the ink tank body.

6. The ink tank apparatus according to claim 1, wherein at least a portion of the lower chamber is in a shape of a semicircle disposed around the head housing of the mixing head device.

7. The ink tank apparatus according to claim 1, further comprising:

a heat transfer member disposed in the ink tank body and surrounding the head housing, the heat transfer member configured to transport a temperature regulating fluid to cool the ink stored in the ink tank body.

8. The ink tank apparatus according to claim 5, wherein the impeller rotates at a predetermined range of speed to establish shear forces to shear respective ink particles which are greater than a predetermined particle size to maintain an ink particle size distribution within a predetermined ink particle size distribution range.

9. The ink tank apparatus according to claim 1, further comprising:

a sensor unit disposed in the ink tank body, the sensor unit configured to determine a density value of the ink stored in the ink tank body; and a density control module configured to control the flow of the concentrated ink through the injection port based on the density value determined by the sensor unit.

10. A method of mixing ink in an ink tank apparatus of an image forming apparatus, the method comprising:

rotating an impeller disposed in a housing cavity of a head housing of a mixing head device located in an ink tank body storing ink therein;

directing concentrated ink having a first set of ink particles into the housing cavity toward the impeller through an injection port disposed on the head housing of the mixing head device;

establishing a suction force between a bottom surface of the ink tank body and the impeller to transport a second set of ink particles disposed proximate to the bottom surface to the impeller; and directing the first set of ink particles and the second set of ink particles against at least one of the impeller and an interior surface of the head housing to reduce the particle size of the respective ink particles in contact therewith and to mix the ink stored in the ink tank body.

11. The method according to claim 10, further comprising:

transporting the ink including the respective reduced-size ink particles from within the housing cavity to outside the housing cavity through a plurality of openings on the head housing.

12. The method according to claim 11, wherein the transporting of the ink including the respective reduced-size ink particles from within the housing cavity to outside the housing cavity further comprises:

providing the ink having the reduced-size ink particles to a fluid applicator unit to form an image on a photoconductive member of the image forming apparatus.

13. The method according to claim 12, wherein the rotating of an impeller operation, the directing concentrated ink into the housing cavity operation, the establishing a suction force operation and the directing the first set of ink particles and the second set of ink particles operation are performed while the fluid applicator unit is forming the image on the photoconductive member.

14. The method according to claim 10, wherein rotating the impeller further comprises:

rotating the impeller at a predetermined range of speed to establish shear forces to shear respective ink particles which are greater than a predetermined particle size to maintain an ink particle size distribution within a predetermined ink particle size distribution range.

15. The method according to claim 14, further comprising:

transporting a temperature regulating fluid through a heat transfer member surrounding the head housing of the mixing head device to cool the ink in the ink tank body.

16. The method according to claim 10, further comprising:

determining a density value of the ink stored in the ink tank body; and controlling the flow of the concentrated ink through the injection port based on the determined density value.

17. The method according to claim 10, wherein the ink tank body comprises:

an upper chamber and a lower chamber disposed below the upper chamber such that the head housing is disposed in the lower chamber, the lower chamber including a bottom surface having a concaved shape with respect to the head housing.

18. A method of mixing ink in an ink tank apparatus of an image forming apparatus, the method comprising:

rotating an impeller disposed in a housing cavity of a head housing of a mixing head device located in an ink tank body storing ink;

directing concentrated ink having a first set of ink particles into the housing cavity toward the impeller through an injection port disposed on the head housing of the mixing head device;

directing at least the first set of ink particles against at least one of the impeller and an interior surface of the head housing to reduce the particle size of the at least first set of ink particles in contact therewith; and transporting the ink including the respective reduced-size ink particles from within the housing cavity to a fluid applicator unit to form an image on a photoconductive member such that the rotating of an impeller operation, the directing concentrated ink into the housing cavity operation, the establishing a suction force operation and the directing at least the first set of ink particles operation are performed while the fluid applicator unit is forming the image on the photoconductive member.

19. The method according to claim 18, further comprising:

establishing a suction force between a bottom surface of the ink tank body and the impeller to transport a second set of ink particles disposed proximate to the bottom surface of the ink tank body to the impeller; and directing the first set of ink particles and the second of ink particles against at least one of the impeller and the interior surface of the head housing to reduce the particle size of the respective ink particles in contact therewith.

20. The method according to claim 18, further comprising:

transporting a temperature regulating fluid through a heat transfer member surrounding the head housing of the mixing head device to cool the ink in the ink tank body.

* * * * *

UNITED STATES PATENT AND TRADEMARK OFFICE

CERTIFICATE OF CORRECTION

PATENT NO. : 8,422,918 B2
APPLICATION NO. : 13/097554
DATED : April 16, 2013
INVENTOR(S) : Jonathan Nir It is certified that error appears in the above-identified patent and that said Letters Patent is hereby corrected as shown below:

In the Claims:

In column 11, line 23, in Claim 19, after "second" insert -- set --.

Signed and Sealed this
Twenty-fourth Day of September, 2013

Teresa Stanek Rea
*Deputy Director of the United States Patent and Trademark Office*